US006789447B1

(12) United States Patent
Zinck

(10) Patent No.: US 6,789,447 B1
(45) Date of Patent: Sep. 14, 2004

(54) REVERSIBLE RATCHET HEAD ASSEMBLY

(76) Inventor: Frederick L. Zinck, 600 S. Elmwood Ave., Glenolden, PA (US) 19036

( * ) Notice: Subject to any disclaimer, the term of this patent is extended or adjusted under 35 U.S.C. 154(b) by 0 days.

(21) Appl. No.: 10/363,074

(22) PCT Filed: Sep. 1, 2000

(86) PCT No.: PCT/US00/24229

§ 371 (c)(1),
(2), (4) Date: Jun. 2, 2003

(87) PCT Pub. No.: WO02/20220

PCT Pub. Date: Mar. 14, 2002

Related U.S. Application Data

(63) Continuation-in-part of application No. PCT/US99/28057, filed on Nov. 23, 1999.

(60) Provisional application No. 60/109,429, filed on Nov. 23, 1998.

(51) Int. Cl.[7] ..... B25B 13/46

(52) U.S. Cl. ..... 81/57.13; 81/57.29; 81/63

(58) Field of Search ..... 81/57.13, 57.29, 81/61–63, 58.1, 63.2; 192/43.1

(56) References Cited

U.S. PATENT DOCUMENTS

| | | | |
|---|---|---|---|
| 2,264,012 | A | 11/1941 | Wasson |
| 2,712,256 | A | 7/1955 | Fish |
| 3,233,481 | A | 2/1966 | Bacon |
| 3,270,595 | A | 9/1966 | Hall et al. |
| 3,529,498 | A | 9/1970 | Northcutt |
| 3,608,683 | A | 9/1971 | Fujisawa |
| 3,867,855 | A | 2/1975 | Siebert |
| 4,259,883 | A | 4/1981 | Carlson |
| 4,346,630 | A | 8/1982 | Hanson |
| 4,528,873 | A | 7/1985 | Lee |
| 4,532,832 | A | 8/1985 | Christensen |
| 4,722,252 | A | 2/1988 | Fulcher et al. |
| 4,974,475 | A | 12/1990 | Lord et al. |
| 4,993,288 | A | 2/1991 | Anderson et al. |
| 5,231,901 | A | 8/1993 | Putney et al. |
| D339,726 | S | 9/1993 | Bruno et al. |
| 5,293,747 | A | 3/1994 | Geiger |
| 5,346,024 | A | 9/1994 | Geiger et al. |
| 5,450,773 | A | 9/1995 | Darrah et al. |
| 5,535,646 | A | 7/1996 | Allen et al. |
| 5,537,899 | A | 7/1996 | Diedrich |
| 5,562,015 | A | 10/1996 | Zinck |
| 5,738,192 | A | 4/1998 | Miner |
| 5,906,244 | A | 5/1999 | Thompson et al. |
| 5,992,540 | A | 11/1999 | Smolinski et al. |
| 6,308,594 | B1 | 10/2001 | Cheng |
| 6,568,298 | B1 * | 5/2003 | Zinck ..... 81/57.13 |

OTHER PUBLICATIONS

Ingersoll–Rand Industrial Tools E–Catalog, Model 55P3, http://dev2.opcenter.net/irecatalo...&ModelNumber=55P3&ReportType=Group, dated Jan. 4, 2000.

Ingersoll–Rand Industrial Tools E–Catalog, Model 100PQ1, http://dev2.opcenter.net/irecatalo...&ModelNumber=100PG1&ReportType=Group, dated Jan. 4, 2000.

International Search Report, PCT/US00/24229, Dec. 17, 2000.

* cited by examiner

*Primary Examiner*—Joseph J. Hail, III
*Assistant Examiner*—David B. Thomas

(57) ABSTRACT

A reversible ratchet head assembly includes a reversal actualor (34) which is received in an opening in an output shaft assembly (48) of a tool. The output shaft assembly carries a pawl (60) which pivots on the output shaft assembly between two positions, one permitting driven rotation of an output shaft of the output assembly in a clockwise direction, and the other permitting driven rotation in a counterclockwise direction. In each position, the pawl permits the tool to be turned in the direction opposite the driven direction for ratcheting operation of the tool. When the direction of rotation is reversed in a powered tool, the reversal actuator moves relative to the output shaft assembly and engages the pawl to automatically switch the pawl from one position to the other. The reversal actuator has two spring-biased fingers **(50*a*. 50*b*) which alternatively engage the pawl to move it into one position or the other. A lug (170) and pocket (180)** arrangement is provided to limit relative rotation between the output shaft assembly and the reversal actuator.

14 Claims, 6 Drawing Sheets

REVERSIBLE RATCHET HEAD ASSEMBLY

BACKGROUND OF THE INVENTION

This invention relates generally to ratchet mechanisms and more particularly to a reversible ratchet head assembly.

Reversing ratchet mechanisms are widely employed in both hand and powered tools. Some tools employ a combination of powered and manual operation. In those tools, for manual operation, a ratchet mechanism is used so that the tool works like a conventional manual ratchet tool. All ratcheting mechanisms use a pawl engageable with ratchet teeth to fix the tool and an output shaft together for conjoint rotation in one direction and to permit relative rotation of the tool relative to the output shaft in another, opposite direction. The direction in which relative rotation is permitted and prevented can be reversed by changing the position of the pawl. Reversal is typically achieved in hand tools, and also in many powered tools, by turning a knob to move the pawl to a different position. Conventionally, the direction the knob is turned is opposite to the direction in which the output shaft will be driven when the tool is used. Thus, there can be some confusion for the operator as to which way to turn the knob because the knob is turned in the direction opposite the direction of the desired driving rotation of the output shaft. An example of a powered tool having such a ratchet reversing mechanism is shown in U.S. Pat. No. 3,529,498. The tool shown in this patent uses an oscillating yoke connected to an output shaft through the pawl.

Certain powered tools reverse the direction of the pawl automatically when the direction of the motor is reversed. An example of such an automatic ratchet reversing mechanism is shown in my U.S. Pat. No. 5,562,015, the disclosure of which is incorporated herein by reference. My prior tool is of the type which permits manual ratcheting operation of the tool when the resistive torque of the fastener being tightened or loosened is greater than can be overcome by the motor. The tool can be turned manually to supply a greater torque to the fastener to overcome its resistence. The position of the pawl is changed by axial movement of a pawl reverser gear (25) which briefly engages a pawl (35) to toggle it from one position to another. The axial movement of the pawl reverser gear is actuated by a change in direction of the motor and the direction in which the pawl is toggled is controlled by the direction of rotation of the motor. The different positions of the pawl permit driven rotation in different directions during manual operation of the tool. The operation of this tool has been most satisfactory. However, the reversing mechanism does require some space within the housing to allow for axial movement of the pawl reverser gear. Accordingly, it would be desirable to have an automatic reversing mechanism of a more compact configuration.

SUMMARY OF THE INVENTION

Among the several objects and features of the invention may be noted the provision of a reversible ratcheting head assembly which is compact in construction; the provision of such a reversible ratcheting head assembly which is capable of operation at higher speeds; the provision of such a reversible ratcheting head assembly which can be directly driven by a motor; the provision of such a reversible ratcheting head assembly which clearly indicates to the operator the direction of driven rotation upon changeover of the direction of driven rotation; and the provision of a ratcheting head assembly which is economical to manufacture and easy to use.

Further among the several objects and features of the present invention may be noted the provision of a powered tool having the features set forth above.

Generally, a powered tool capable of also operating as a manual ratchet tool. The powered tool includes a housing including a head and ratchet teeth disposed internally of the head. A reversible motor is in the housing. A reversal actuator is mounted in the housing and operatively connected to the motor to be driven in rotation by the motor. An output shaft assembly is generally in the head of the housing and is attached to the reversal actuator for rotation of the reversal actuator relative to the output shaft assembly in a first direction over an arc and for conjoint rotation with the reversal actuator in the first direction after rotation over the arc in the first direction, and for rotation of the reversal actuator relative to the output shaft assembly in a second direction opposite the first direction over the arc and for conjoint rotation with the reversal actuator in the second direction after rotation over the arc in the second direction. The attachment of the output shaft assembly to the reversal actuator allows rotation of the reversal actuator relative to the output shaft assembly over the arc to occur upon reversal of the motor. The output shaft assembly also includes a ratchet pawl pivotally mounted on the output shaft assembly and engageable with the ratchet teeth on the head. The pawl is pivotable between a first position in which the pawl engages the ratchet teeth to hold the output shaft assembly and head together for conjoint rotation in one direction and permit relative rotation between the output shaft assembly and the head in another direction opposite to the one direction, and a second position in which the pawl engages the ratchet teeth to hold the output shaft assembly and head together for conjoint rotation in the other direction and to permit relative rotation between the output shaft assembly and the head in the one direction thereby to permit manual ratcheting operation of the tool. The reversal actuator is adapted to engage the pawl for pushing the pawl between the first and second positions upon relative rotation between the output shaft assembly and the reversal actuator whereby manual ratcheting is automatically reversed upon reversal of the motor. One of the reversal actuator and the output shaft assembly has a lug with a pair of spaced apart oppositely facing first surface portions and the other of the reversal actuator and the output shaft assembly having a pocket with a pair of spaced apart second surface portions facing one another and being spaced apart a distance greater the spacing of the fast surface portions. The lug is positioned in the pocket and movable therein with engagement between the first and second surface portions limiting the relative rotation between the reversal actuator and the output shaft assembly.

Other objects and features of the present invention will be in part apparent and in part point out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
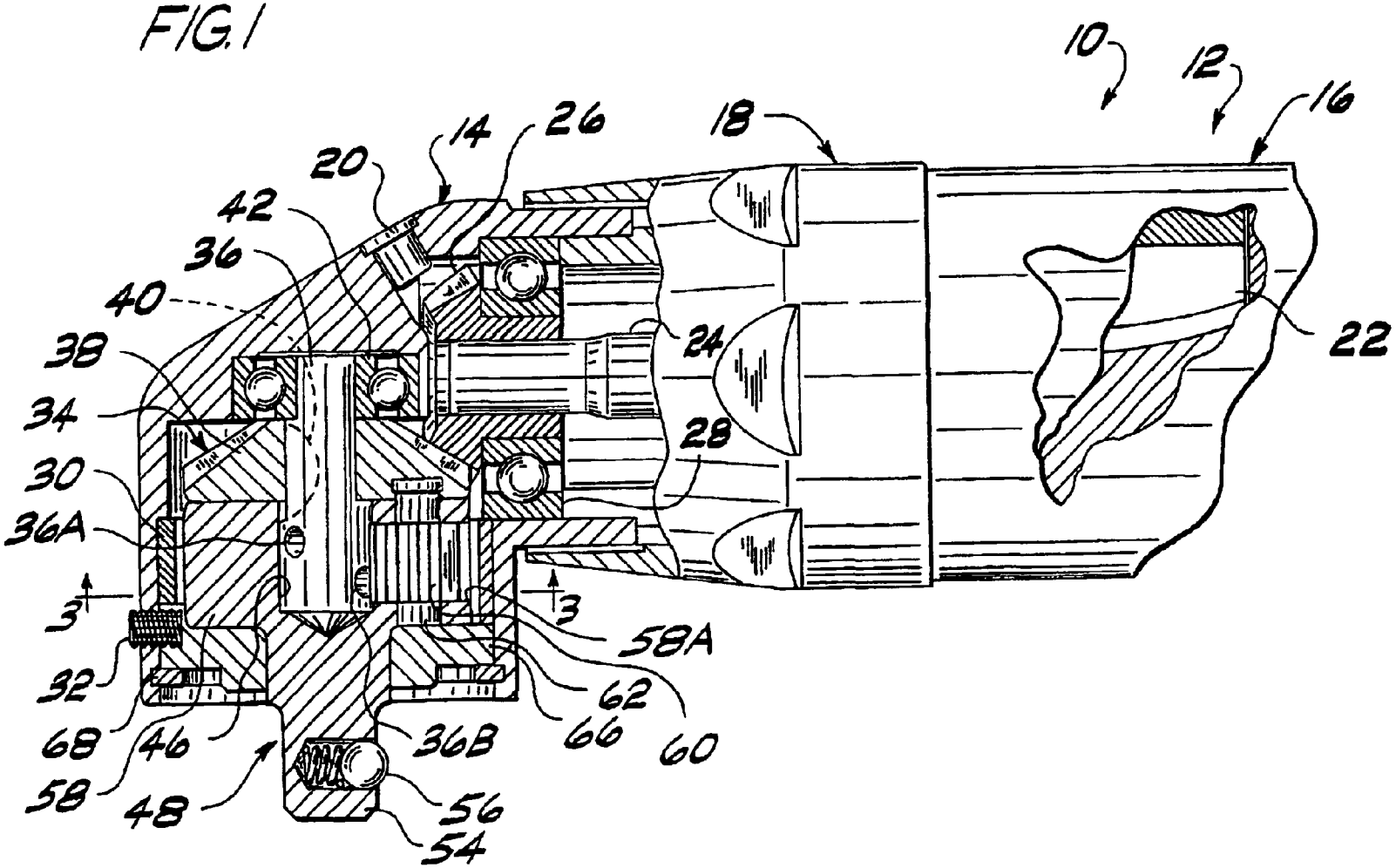
FIG. 1 is a fragmentary side elevational view of a powered tool of the present invention showing a ratchet head assembly of the tool in section.
Figure 5:
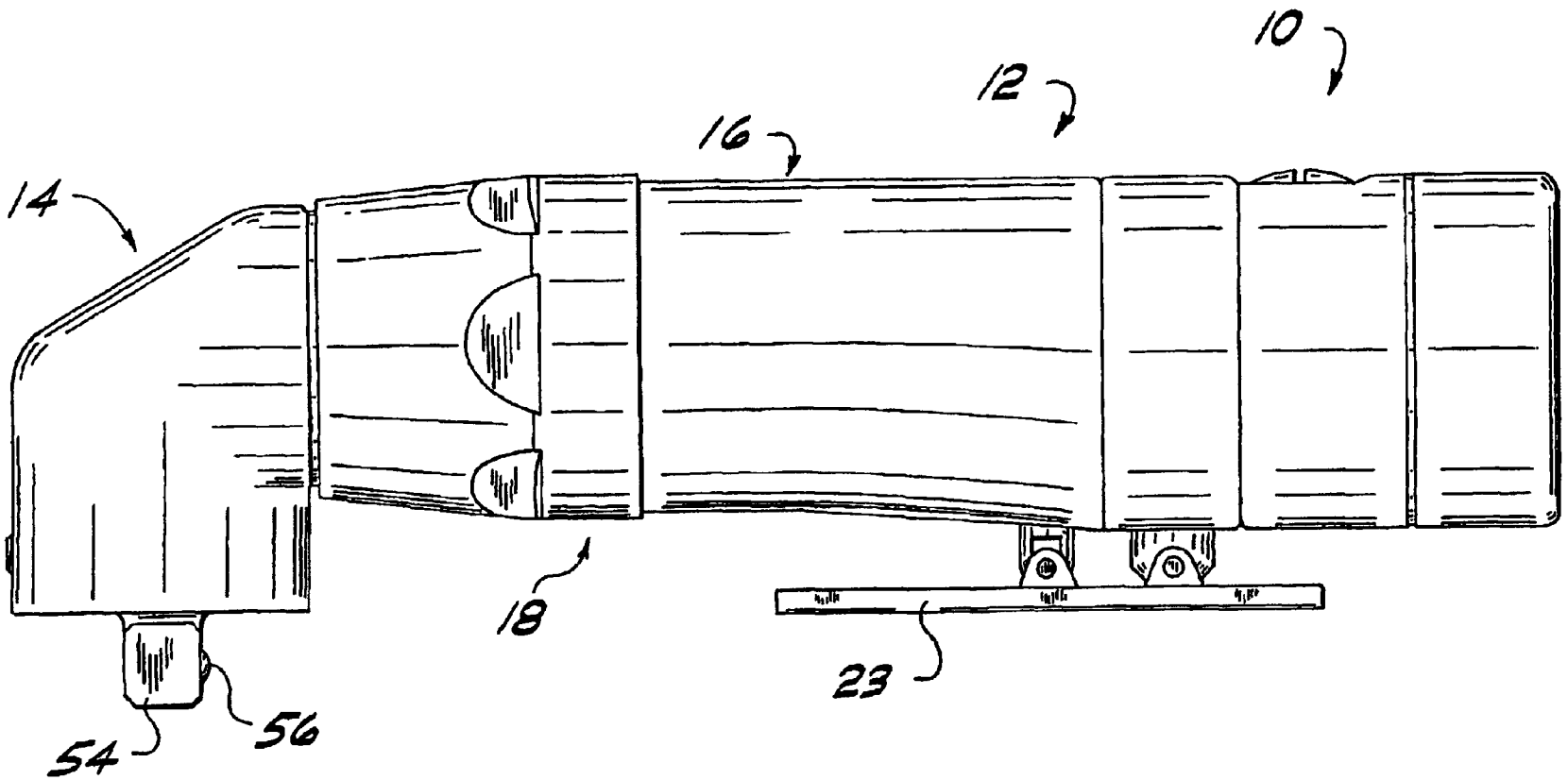
FIG. 5 is a side elevational view of the powered tool.

Referring now to the drawings and in particular to FIGS. 1 and 5, a powered wrench 10 of the present invention is shown to comprise a housing 12 including a head 14, a body 16 and a collar 18 interconnecting the head and body (the reference numbers designating their subjects generally). The head 14 is shown as a piece separate from the body 16, but could be formed as one piece with the body (i.e., without the collar 18). Moreover, the head itself could be formed of several pieces attached together. A cap 20 closes a lubrication opening in the head 14. The wrench 10 illustrated in the drawings is a pneumatic wrench having a reversible air motor 22 located within the body 16. The motor 22 is actuated by a lever 23 connect to a reversing valve (not shown) within the wrench 10. Examples of such reversing valves are shown in U.S. Pat. No. 5,423,350 and my co-pending U.S. application Ser. No. 60/111,184, filed Dec. 7, 1998, the disclosure of which is incorporated herein by reference. A drive shaft 24 connected to the motor 22 for rotation by the motor has a first bevel gear 26 at its upper end. The first bevel gear and shaft are received in a bearing 28 at the upper end. It is to be understood that although a tool having a pneumatic motor 22 is shown, a tool may have other types of motors, such as an electric motor (battery powered or otherwise) or a hydraulic motor, without departing from the scope of the present invention.

A reversible ratchet assembly of the wrench 10 comprises the hollow head 14 of the housing 12, and further includes a ratchet gear ring 30 fixedly mounted on the inside of the head by a set screw 32. The ratchet gear ring 30 is formed as a separate piece and inserted into the head 14, but could be formed in other ways such as by machining the teeth into the material of the head A reversal actuator generally indicated at 34 comprises a shaft 36 and a second bevel gear 38 affixed to the shaft by a key 40. The shaft 36 is received in a bearing 42 mounted in the head 14 for rotation of the reversal actuator 34 about the longitudinal axis of the shaft. The second bevel gear 38 extends radially outwardly from the shaft 36 and has an arcuate groove 44 on its outer face (see FIG. 2).

Figure 2:
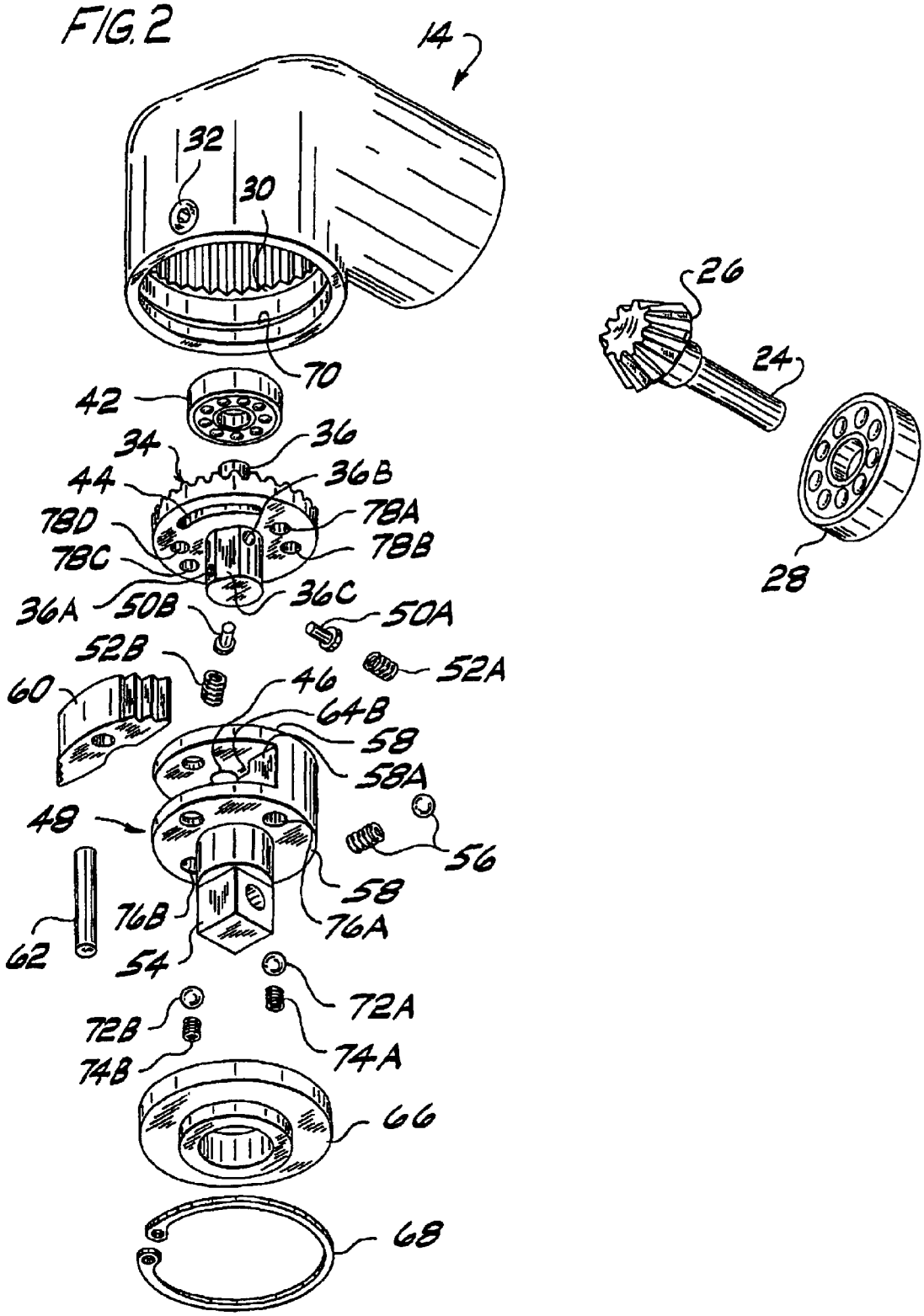
FIG. 2 is an exploded perspective view of the ratchet head assembly.
Figure 3:
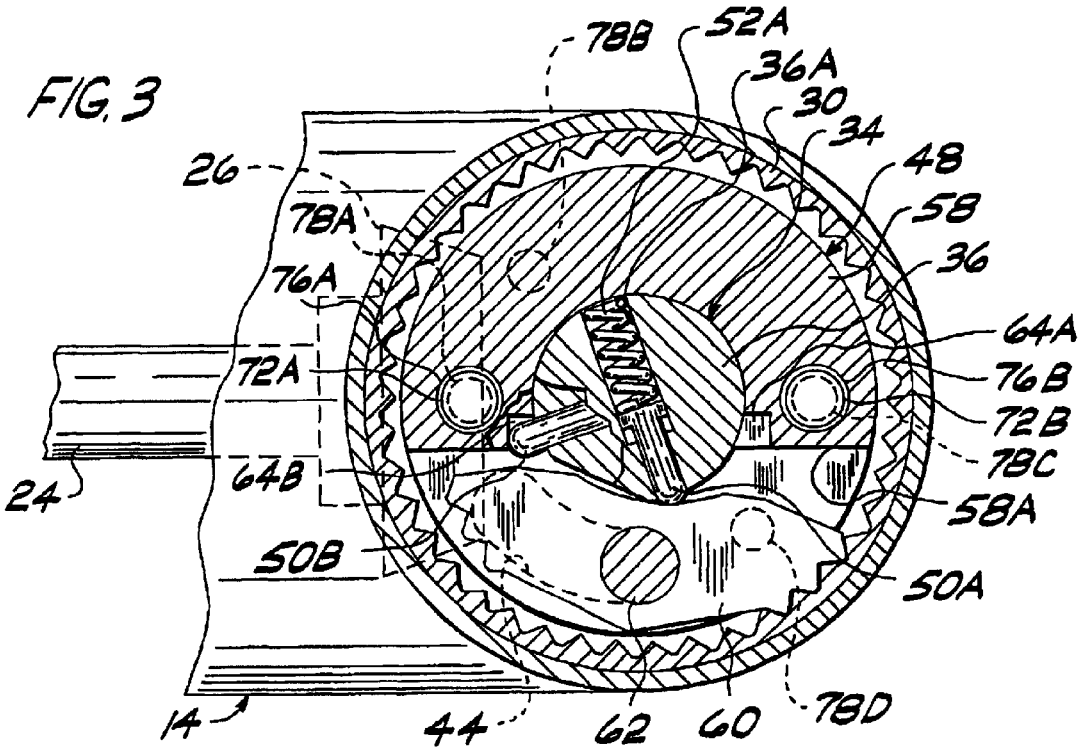
FIG. 3 is a fragmentary section taken in the plane including line 3—3 of FIG. 1 and showing a pawl in a first position.

The second bevel gear 38 is enmeshed with the first bevel gear 26 of the drive shaft 24 such that the reversal actuator 34 is directly driven by the drive shaft. The end of the shaft 36 opposite the bearing 42 is received in an opening 46 in an output shaft assembly (indicated generally at 48) and is concentric with the output shaft assembly. The shaft 36 has two radial bores 36A, 36B which are axially separate from each other and which are angularly offset at an angle of about 100°. Referring to FIGS. 2 and 3, reversing fingers (designated 50A, 50B, respectively) are received in respective ones of the radial bores 36A, 36B and project outwardly from the bores. Springs 52A, 52B received in the radial bores 36A, 36B bear at one end against the output shaft assembly 48 within the opening 46 and against respective reversing fingers 50A, 50B at the other end to bias the fingers to project radially outwardly from the radial bores. Each radial bore 36A, 36B has been counterbored so that a shoulder formed on one end of each reversing finger 50A, 50B engages the output shaft assembly 48 within the radial bore to hold the finger in the bore.

The output shaft assembly 48 includes an output shaft 54 projecting outwardly from the head 14 and constructed to receive attachments, such as a socket (not shown), for driving rotation of the attachment. In the illustrated embodiment, the output shaft 54 has a conventional ball and spring retention unit 56 for releasably holding the attachment on the output shaft. The output shaft assembly 48 has a wide base 58 located in the head 14 and an arcuate slot 58A on one side thereof receiving a ratchet pawl 60. The pawl is pivotally mounted on the base 58 in the arcuate slot 58A by a pin 62 which permits the pawl 60 to pivot relative to the base on the pin about an axis which is parallel to an axis of rotation of the output shaft assembly 48. The pawl 60 is elongate and has ratchet teeth formed in its opposite longitudinal ends. The teeth at the opposite ends of the pawl 60 are alternatively engageable with the teeth of the ratchet gear ring 30 by pivoting of the pawl on the pin 62 to interconnect the output shaft assembly 48 and the ratchet gear ring for manual ratcheting operation of the wrench 10 in different directions, as will be described below. The pin 62 extends out of the arcuate slot 58A through the base 58 on an inner face of the base and into the arcuate groove 44 in the second bevel gear 38 of the reversal actuator 34. The pin 62 and groove 44 are the only structures in the illustrated embodiment which interconnect the reversal actuator 34 and the output shaft assembly 48 to positively limit their relative rotation. However, different configurations (not shown) for interconnection of the reversal actuator 34 and output shaft assembly 48 are possible without departing from the scope of the invention. For instance, a second pin associated with the output shaft assembly and a second arcuate groove associated with the second bevel gear could be provided for additional strength. Moreover, a pin or pins could be associated with the reversal actuator and a groove or grooves with the output shaft assembly. The pin might also be formed integrally (e.g., as a tab) with either the output shaft assembly or reversal actuator without departing from the scope of the present invention.

The opening 46 in the output shaft assembly 48 which receives the shaft 36 of the reversal actuator 34 also opens into the arcuate slot 58A in the base 58 of the output shaft assembly. The shaft 36 is partially exposed in the arcuate slot 58A proximately to the pawl 60. A flat 36C formed on the shaft provides clearance for pivoting of the pawl 60 and turning of the shaft. In addition, the reversing fingers 50A, 50B of the reversal actuator 34 project out of their radial bores 36A, 36B into the arcuate slot 58A. The reversing fingers 50A, 50B are alternately engageable with the pawl 60 upon relative rotation between the reversal actuator 34 and output shaft assembly 48 to pivot the pawl on the pin 62. The shaft 36 is also initially engageable with the pawl near the edges of the flat 36C to positively force the teeth of the pawl out of engagement with the ratchet gear ring 30. Two cutouts 64A, 64B (FIG. 3) at the bottom of the arcuate slot 58A are capable of receiving respective ones of the reversing fingers 50A, 50B, and provide the room for the full range of motion of the fingers. As will be apparent from the description of the operation hereinafter, the reversing fingers 50A, 50B pivot the pawl 60 upon reversal of the motor 22 so that the direction of ratcheting is automatically changed when the motor is reversed.

A cover 66 received in the head 14 overlies the base 58 of the output shaft assembly 48 and has an opening through which the output shaft 54 projects out of the head. The cover 66, output shaft assembly 48 and reversal actuator 34 are held in the head 14 by a snap ring 68 received in an annular groove 70 in the head. The cover 66 also holds a pair of releasable locking balls 72A, 72B and associated springs 74A, 74B in respective holes 76A, 76B through the base 58 of the output shaft assembly 48. The springs 74A, 74B engage the cover 66 at the outer face of the base 58 and bias their corresponding balls 72A, 72B out of the holes 76A, 76B at the inner face of the base against the outer face of second bevel gear 38. Four recesses (designated 78A–78D, respectively) formed in the outer face of the second bevel gear 38 are capable of receiving the balls 72A, 72B to releasably lock the reversal actuator 34 and output shaft assembly together in two selected positions. However, the bias of the springs 74A, 74B can be overcome to lift the balls 72A, 72B out of the recesses to permit relative rotation of the reversal actuator 34 within the output shaft assembly base 58 to toggle the pawl 60.

Having described the construction of the powered wrench 10, its operation will now be described with particular reference to FIGS. 3 and 4. FIG. 3 shows the relative configuration of the reversal actuator 34 and output shaft assembly 48 when the wrench 10 is operating to turn the output shaft assembly in a clockwise direction. The reversing finger 50A engages the pawl 60 to the right of the pin 62, resiliently biasing the right end of the pawl against the ratchet gear ring 30 in a first position. The pin 62 engages the reversal actuator 34 in the right end of the arcuate groove 44 so that driven clockwise rotation of the reversal actuator pulls the pin, and hence the output shaft assembly 48, in conjoint clockwise rotation. Engagement of the right end of the pawl 60 with the ratchet gear ring 30 permits clockwise rotation of the output shaft assembly 48 within the head 14, but prevents counterclockwise rotation. If the torque capacity of the motor 22 is exceeded and manual operation is desired, the housing 12 including the head 14 can be turned clockwise to continue clockwise turning of the output shaft assembly 48. Clockwise movement of the head 14 will drive the teeth of the ratchet gear ring 30 into gripping engagement with the teeth on the right end of the pawl 60 so that the pawl holds the head and output shaft assembly 48 together for conjoint rotation in the clockwise direction.

Conventional ratcheting operation is also permitted, allowing the fastener (not shown) to be turned by an oscillating motion of the housing 12 in the fashion of a manual ratchet tool. Rotation of the head 14 in a counterclockwise direction results in the pawl 60 pivoting on the pin 62 in a counterclockwise direction to release the interconnection of the output shaft assembly 48 and the head so that the housing 12 can be turned counterclockwise without turning the output shaft assembly. The reversing finger 50A engaging the pawl 60 continuously biases, by operation of the spring 52A, the pawl toward engagement with the ratchet gear ring 30 so that ratcheting engagement is maintained. The locking balls 72A, 72B are received in the recesses 78A, 78C of the second bevel gear 38 of the reversal actuator 34 in the FIG. 3 position. The locking balls 72A, 72B hold the reversal actuator 34 together with the output shaft assembly 48 when the housing 12 is being turned counterclockwise so that the reversing finger 50A maintains its position for biasing the pawl 60 into engagement with the ratchet gear ring 30. Relative motion between the reversal actuator 34 and the output shaft assembly 48 when torque is released by counterclockwise movement of the housing 12 could cause the pawl 60 to pivot in such a fashion as to jam the wrench 10 or otherwise cause improper operation of the ratchet head assembly.

Figure 4:
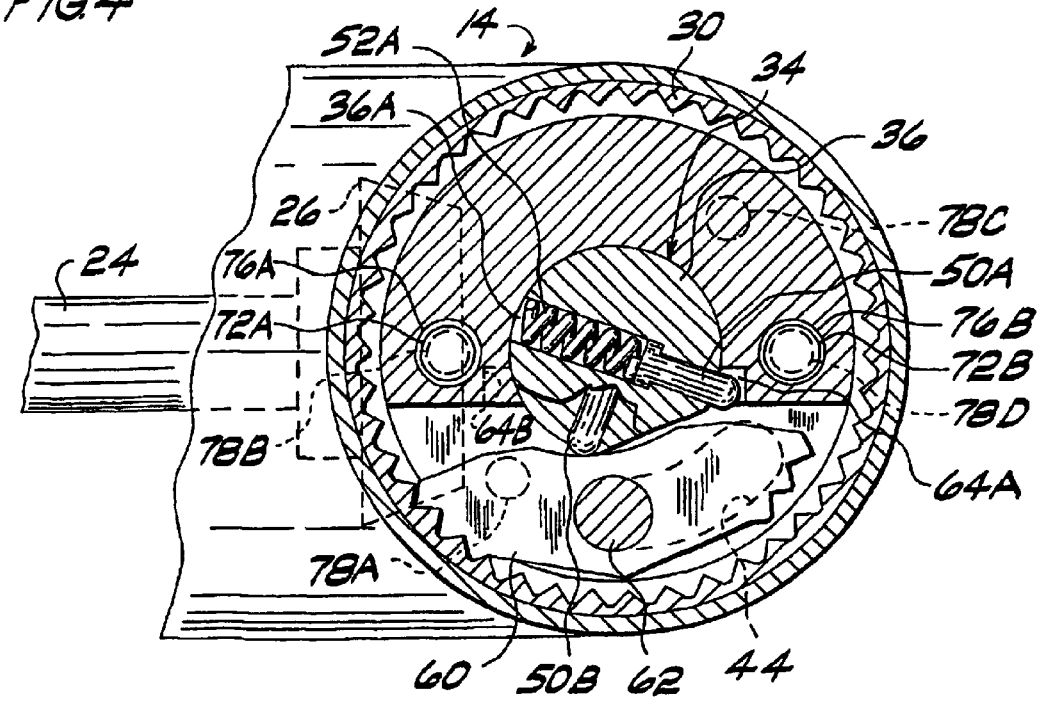
FIG. 4 is the section of FIG. 3 showing the pawl in a second position.

It will be readily apparent that when the reversal actuator 34 and output shaft assembly 48 are in the configuration shown in FIG. 4, the wrench housing 12 may be used to drive the output shaft 54 in a counterclockwise direction. Independent rotation of the head 14 relative to the output shaft assembly 48 is now permitted in the clockwise direction for manual ratcheting operation of the wrench 10. In the FIG. 4 configuration, the reversing finger 50B now engages the pawl 60 to pivot the left end of the pawl into engagement with the ratchet gear ring 30 in a second position. The locking balls 72A, 72B are now received in the recesses 78B, 78D of the reversal actuator 34 to hold the reversal actuator and output shaft assembly 48 against relative rotation.

Changeover from the driven clockwise rotation of the output shaft assembly 48 illustrated in FIG. 3 to the driven counterclockwise rotation driven in FIG. 4 occurs automatically upon reversal of the motor 22. Rotation of the reversal actuator 34 in a counterclockwise direction by operation of the motor 22 has sufficient torque to force the locking balls 72A, 72B out of the recesses 78A, 78C in the second bevel gear 38 so that the reversal actuator may turn relative to the output shaft assembly 48. Relative rotation is also permitted by the arcuate groove 44 in the second bevel gear 38 which moves counterclockwise under the pin 62. The extent of relative rotation of the reversal actuator 34 relative to the output shaft assembly 48 is limited to the arc of the groove 44. Once the left end of the groove 44 contacts the pin 62 (as in FIG. 4), continued counterclockwise rotation of the reversal actuator 34 results in conjoint counterclockwise rotation of the output shaft assembly 48. At the same time the left end of the groove 44 engages the pin 62, the balls 72A, 72B fall into the recesses 78D, 78D to releasably lock the reversal actuator 34 and the output shaft assembly 48 against inadvertent relative rotation.

As the reversal actuator 34 moves counterclockwise from the FIG. 3 configuration, the reversing finger 50A engaging the pawl 60 moves counterclockwise out of engagement with the pawl and into the cutout 64A (see FIG. 4). Simultaneously, the reversing finger 50B moves out of its cutout 64B and into engagement with the left end of the pawl 60. Just before the finger 50B engages the pawl 60, the shaft 36 engages the pawl at the left edge of the flat 36C. The shaft provides a strong force to push the pawl 60 out of engagement with the teeth of the ratchet gear ring 30. It is envisioned that either the fingers 50A, 50B alone or the shaft 36 alone could be used to reverse the pawl. However, if only the shaft is used, some other structure (not shown) to resiliently bias the pawl 60 into engagement with the ratchet gear ring would be needed. Continued counterclockwise movement of the reversing finger 50B pivots the pawl 60 in a counterclockwise direction on the pin 62 so that the teeth on the left end of the pawl engage the teeth of the ratchet gear ring 30. The reversing finger 50B now resiliently biases the left end of the pawl 60 into engagement with the ratchet gear ring 30 in the same way as the reversing finger 50A did in the FIG. 3 configuration.

It will be readily apparent from the foregoing description how the pawl 60 will be automatically reversed back to the FIG. 3 configuration for clockwise driven rotation from the configuration of FIG. 4. Accordingly, no further description will be provided.

Figure 6:
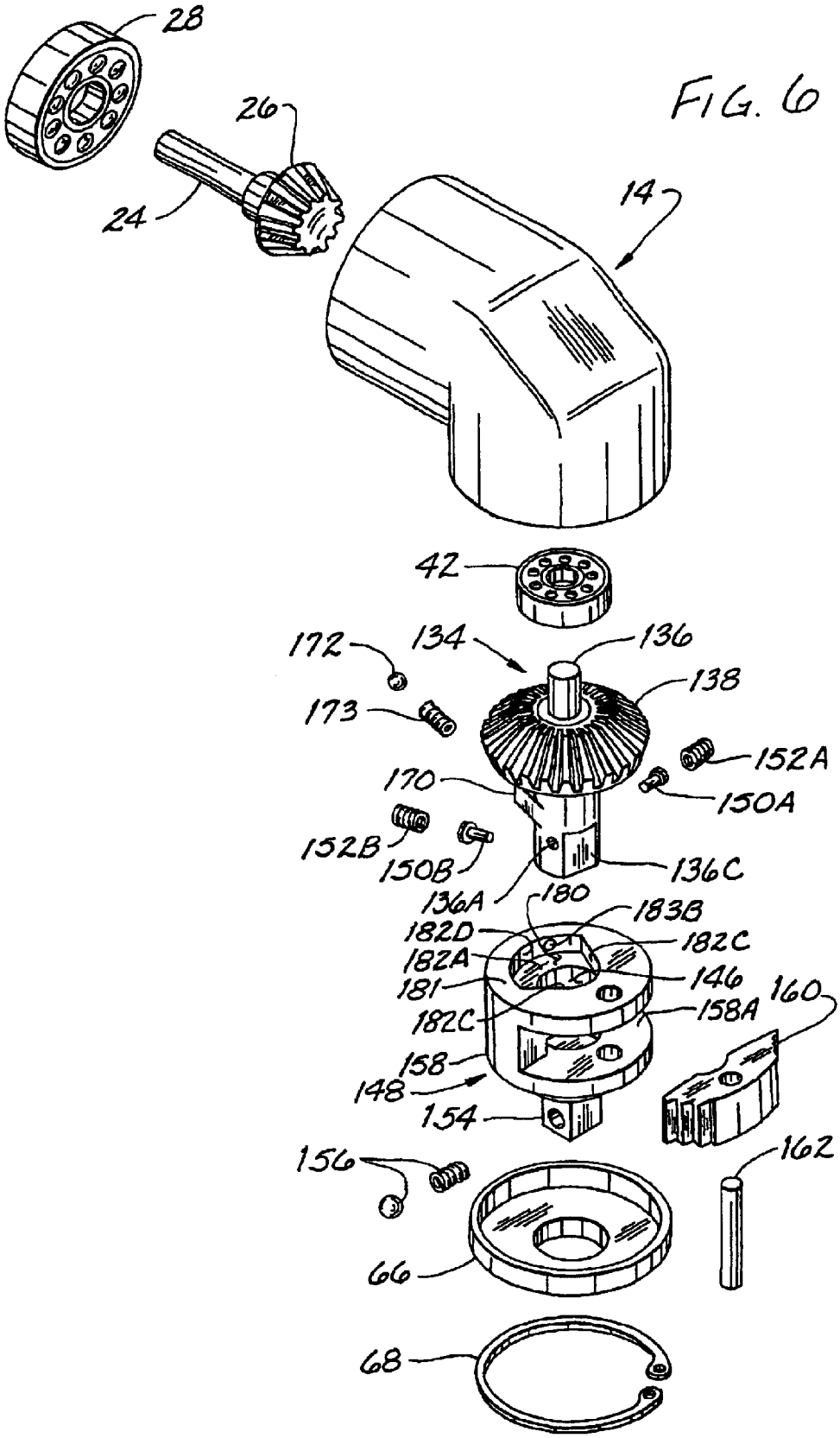
FIG. 6 is an exploded perspective view of a second form of ratchet head assembly.
Figure 7:
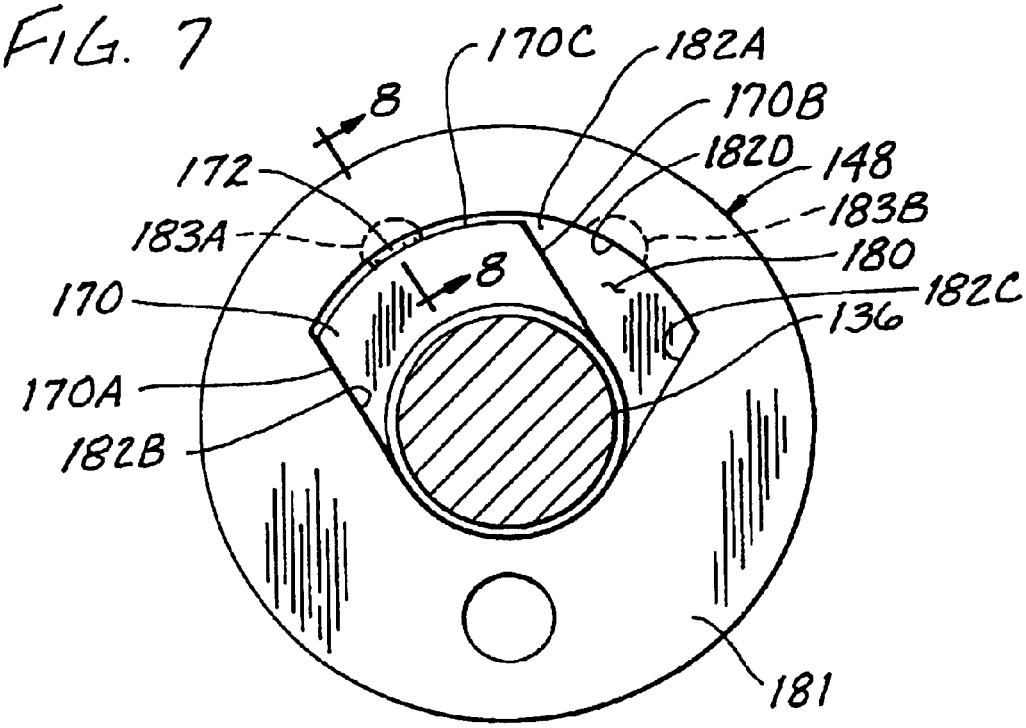
FIG. 7 is a transverse section of the ratchet head assembly of FIG. 6 with a lug of a reversal actuator received in a pocket in an output shaft assembly.
Figure 8:
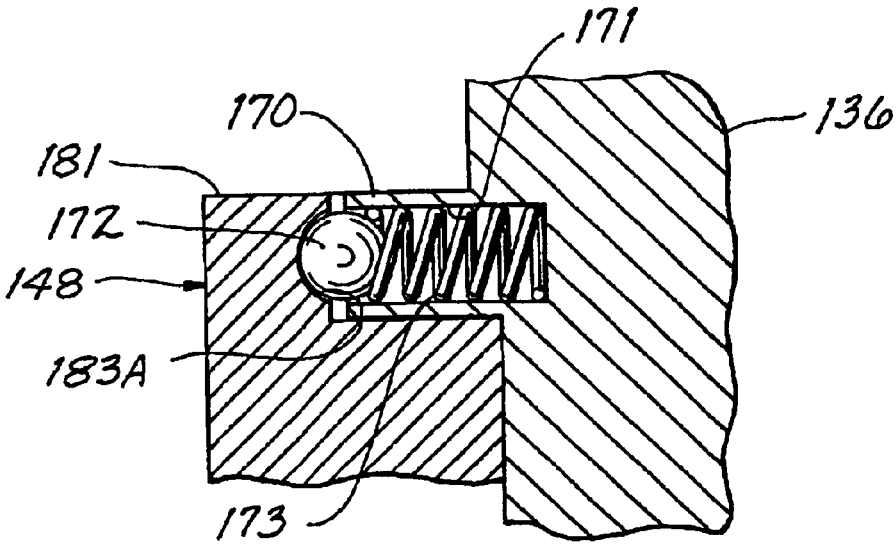
FIG. 8 is a fragmentary section taken in the plane including line 8—8 of FIG. 7.

FIGS. 6–8 illustrate a second embodiment of the present invention with a modified reversal actuator and output shaft assembly. The modification pertains to the way in which the reversal actuator and output shaft assembly engage each other for conjoint rotation. Parts of the reversal actuator and output shaft assembly that are identical or similar to parts in the embodiment shown in FIGS. 1–5 are designated with the same numeral but with a "1" prefix (the parts are thus designated with numbers in the "100's"). Not all parts with such a "1" prefix though have a corresponding part in the first embodiment. A reversal actuator generally indicated at 134 comprises a shaft 136 and a second bevel gear 138 affixed to the shaft as by a press fit and a key (not shown). The shaft 136 is received in a bearing 42 mounted in the head 14 for rotation of the reversal actuator 134 about the longitudinal axis of the shaft. The second bevel gear 138 extends radially outwardly from the shaft 136. The second bevel gear 138 is enmeshed with the first bevel gear 26 of the drive shaft 24 such that the reversal actuator 134 is directly driven by the drive shaft. The end of the shaft 136 opposite the bearing 42 is received in an opening 146 in an output shaft assembly (indicated generally as 148) and is concentric with the output shaft assembly. The shaft 136 has two bores 136A, 136B which are axially separate from each other and which are angularly offset at an angle of about 100°. Referring to FIG. 6, reversing fingers (designated 150A, 150B, respectively) are received in respective ones of the bores 136A, 136B and project outwardly from the bores. Springs 152A, 152B received in the bores 136A, 136B bear at one end against the output shaft assembly 148 within the opening 146 and against respective reversing fingers 150A, 150B at the other end to bias the fingers to project outwardly from the bores. Each bore 136A, 136B has been counterbored so that a shoulder formed on one end of each reversing finger 150A, 150B engages the output shaft assembly 148 within the radial bore to hold the finger in the bore.

A lug 170 (FIG. 7) extends radially from the shaft 136 and is positioned longitudinally between the bevel gear 138 and a flat 136C on the shaft. The lug 170 includes a pair of circumferentially spaced and oppositely facing side surfaces 170A, 170B forming stop shoulders. A front surface 170C extends in an arc between and connects the side surfaces 170A, 170B. A radially extending receptacle 171 opens onto the surface 170C and contains a ball 172 biased to a position projecting out of the surface 170C by a spring 173 (FIG. 8).

The output shaft assembly 148 includes an output shaft 154 projecting outwardly from the head 14 and constructed to receive attachments, such as a socket (not shown), for driving rotation of the attachment. A cover 66 received in the head 14 overlies the base 158 of the output shaft assembly 148 and has an opening through which the output shaft 154 projects out of the head. In the illustrated embodiment, the output shaft 154 has a conventional ball and spring retention unit 156 for releasably holding the attachment on the output shaft. The output shaft assembly 148 has a base 158 located in the head 14 and an arcuate slot 158A on one side thereof receiving a ratchet pawl 160. The cover 66, output shaft assembly 148 and reversal actuator 134 are held in the head 14 by a snap ring 68 received in an annular groove 70 (see FIG. 2) in the head The pawl 160 is pivotally mounted on the base 158 in the arcuate slot 15 8A by a pin 162 which permits the pawl 160 to pivot relative to the base on the pin about an axis which is parallel to an axis of rotation of the output shaft assembly 148. The pawl 160 is elongate and has ratchet teeth formed in its opposite longitudinal ends. The teeth at the opposite ends of the pawl 160 are alternatively engageable with the teeth of the ratchet gear ring 30 (see FIG. 2) by pivoting of the pawl on the pin 162 to interconnect the output shaft assembly 148 and the ratchet gear ring for manual ratcheting operation of the wrench 10 in different directions.

The bore 146 in the output shaft assembly 148 which receives the shaft 136 of the reversal actuator 134 also opens into the arcuate slot 158A in the base 158 of the output shaft assembly. The shaft 136 is partially exposed in the arcuate slot 158A proximately to the pawl 160. A flat 136C formed on the shaft provides clearance for pivoting of the pawl 160 and turning of the shaft. In addition, the reversing fingers 150A, 150B of the reversal actuator 134 project out of their bores 136A, 136B into the arcuate slot 158A. The reversing fingers 150A, 150B are alternately engageable with the pawl 160 upon relative rotation between the reversal actuator 134 and output shaft assembly 148 to pivot the pawl on the pin 162. The reversing fingers 150A, 150B pivot the pawl 160 upon reversal of the motor 22 so that the direction of ratcheting is automatically changed when the motor is reversed. The operation of the fingers 150A, 150B and pawl 160 upon relative rotation of the reversal actuator 134 and output shaft assembly 148 is identical to that of the fingers 50A, 50B and pawl 60 of the first embodiment (FIGS. 1–5) and will not be described in further detail.

A pocket 180 is recessed in the top surface 181 of the base 158 and opens toward the bevel gear 138 (FIG. 7). The pocket 180 is defined by a bottom surface 182A that is parallel to and engageable with the bottom surface of the lug 170. The pocket is further defined by a pair of surfaces 182B, 182C that extend generally tangentially from a projection of the circumference of the bore 184 and an end surface 182D extending between and connecting the surfaces 182B, 182C. The bore 146 receives the lower end of the shaft 136 for rotation therein. The surface 182D is arcuate and shaped generally the same as the end surface 170C of the lug 170 and radially spaced outwardly therefrom. A pair of radially inwardly opening receptacles 183A, 183B are recessed in the surface 182D and are positioned to receive the ball 172 therein to provide a yieldable lock to resist relative rotation between the reversal actuator and the output shaft assembly. The receptacles are spaced apart circumferentially an angle of arc approximately equal to the desired angle of arc of relative rotation between the reversal actuator and the output shaft assembly. The ball 172 under the bias of the spring extends into one or the other of the receptacles 183A, 183B when the reversal actuator is at opposite ends of relative rotation with the output shaft assembly. While the ball 172 and spring 173 are shown as mounted on the lug and the receptacles 183A, 183B are shown as being in the surface 182D, the arrangement may be reversed if desired.

When the drive shaft 136 is being driven in the counterclockwise direction (as viewed in FIG. 7) the surface 170A of the lug 170 engages the surface 182B of the pocket so that the output shaft assembly 148 is driven conjointly with the drive shaft for powered rotation. The pawl 160 will be in a position to permit manually driven conjoint rotation of the output shaft assembly 148 and the wrench 10. However when the wrench is manually turned in a clockwise direction, the pawl permits relative motion between the wrench and the output shaft assembly 148. The ball 172 biased by the spring 173 into the receptacle 183A holds the reversal 134 actuator and output shaft assembly 148 from any relative motion during manual ratchet operation of the wrench.

As with the first embodiment, changing the direction of the motor 22 automatically switches the position of the pawl 160 to reconfigure the motor for manual ratcheting operation in the reverse (e.g., clockwise direction). Reversing the motor 22 causes the shaft 136 of the reversal actuator 134 to move in a clockwise direction from that shown in FIG. 7. The impact force of the motor 22 applied through the shaft 136 is sufficient to dislodge the ball 172 from the receptacle 183A and permit the reversal actuator 134 to rotate clockwise relative to the output shaft assembly 148. Thus, the lug 170 rotates clockwise in the pocket 180 from the position shown in FIG. 7. The surface 170A of the lug disengages the surface 182B of the pocket. Relative rotation of the lug 170 in the pocket 180 continues until the surface 170B engages the surface 182C of the pocket 180. After engagement of the lug surface 170B with the pocket surface 182C, the reversal actuator 134 and output shaft assembly 148 rotate conjointly in a clockwise direction as driven by the motor 22. The ball 172 is received now in the receptacle 183B to prevent relative rotation between the reversal actuator 134 and the output shaft assembly 148 during manual ratcheting operations with the wrench 10. The relative movement of the reversal actuator 134 switches the position of the pawl 160, as described for the first embodiment, so that manual driven rotation is permitted in the clockwise direction.

The engagement of the lug surfaces 170A or 170B with the pocket surfaces 182B or 182C is over a relatively substantial area of the lug 170. The chance of breaking the lug 170 is reduced as a result over the changes of breaking the pin 62 which performs the function of the lug in the first embodiment (FIGS. 1–5). The construction is also somewhat simpler than that of the first embodiment in that the need for the balls 72A, 72B, springs 74A, 74B and recesses 78A–78D is eliminated.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense. In addition to the different embodiments described above, at least three other variants (not shown) within the scope of the present invention are envisioned. A tool which is entirely straight (e.g., a ratcheting screwdriver) could be constructed, so that no right angle transmission of the motor rotation would be necessary. In that event, the reversal actuator could be part of the output shaft and not a distinct element. The ratchet head assembly could also be incorporated into a conventional oscillating yoke ratchet tool. The yoke would replace the fixed ratchet ring 30 of the illustrated embodiment for engagement with the pawl to drive rotation of the output shaft assembly. The reversal actuator would not be connected to the motor at all, but would instead extend outward to a knob which could be manually turned to achieve reversal of the tool. The ratchet head assembly is readily applicable to a totally manual tool (i.e., having no motor). The reversal actuator would be connected to a knob to change direction of operation of the tool. The ratchet gear ring would be fixed within the head of the tool, substantially as in the illustrated embodiment. The construction of the ratchet assembly permits the knob to be turned to position the pawl for driven rotation in the same direction as the knob is turned. In other words, when the knob is turned clockwise, the operator immediately knows that driven rotation will be in the clockwise direction and vice versa.

What is claimed is:

1. A powered tool capable of operating as a manual ratchet tool the powered tool comprising:

a housing including a head and ratchet teeth disposed internally of the head;

a reversible motor in the housing;

a reversal actuator mounted in the housing and operatively connected to the motor to be driven in rotation by the motor;

an output shaft assembly generally in the head of the housing, the output shaft assembly being attached to the reversal actuator for rotation of the reversal actuator relative to the output shaft assembly in a first direction over an arc and for conjoint rotation with the reversal actuator in the first direction after rotation over the arc in the first direction, and for rotation of the reversal actuator relative to the output shaft assembly in a second direction opposite the first direction over the arc and for conjoint rotation with the reversal actuator in the second direction after rotation over the arc in the second direction, whereby the attachment of the output shaft assembly to the reversal actuator allows rotation of the reversal actuator relative to the output shaft assembly over the arc to occur upon reversal of the motor, the output shaft assembly further comprising a ratchet pawl pivotally mounted on the output shaft assembly and engageable with the ratchet teeth on the head, the pawl being pivotable between a first position in which the pawl engages the ratchet teeth to hold the output shaft assembly and head together for conjoint rotation in one direction and permit relative rotation between the output shaft assembly and the head in another direction opposite said one direction, and a second position in which the pawl engages the ratchet teeth to hold the output shaft assembly and head together for conjoint rotation in said other direction and to permit relative rotation between the output shaft assembly and the head in said one direction thereby to permit manual ratcheting operation of the tool;

the reversal actuator being adapted to engage the pawl for pushing the pawl between said first and second positions upon relative rotation between the output shaft assembly and the reversal actuator whereby manual ratcheting is automatically reversed upon reversal of the motor;

one of the reversal actuator and the output shaft assembly having a lug with a pair of spaced apart oppositely facing first surface portions and the other of the reversal actuator and the output shaft assembly having a pocket with a pair of spaced apart second surface portions facing one another and being spaced apart a distance greater the spacing of the first surface portions, said lug being positioned in said pocket and movable therein with engagement between the first and second surface portions limiting the relative rotation between the reversal actuator and the output shaft assembly.

2. A powered tool as set forth in claim 1 further comprising a resilient, yieldable lock adapted to interconnect the output shaft assembly and the reversal actuator to inhibit relative rotation between the output shaft assembly and the reversal actuator unless the motor is reversed.

3. A powered tool as set forth in claim 2 wherein the lock comprises a ball and a spring disposed in a first receptacle associated with one of the reversal actuator and the output shaft assembly, the spring biasing the ball outwardly of the first receptacle, the ball being selectively receivable in one of a pair of second receptacles in the other of the reversal actuator and the output shaft assembly when the first receptacle is aligned with either of the second receptacles for yieldably resisting relative rotation of the output shaft assembly and the reversal actuator.

4. A powered tool as set forth in claim 1 wherein the reversal actuator includes a shaft and the lug projects radially outward of the reversal actuator shaft, and wherein the pocket is in the output shaft assembly.

5. A powered tool as set forth in claim 4 further comprising a resilient, yieldable lock adapted to interconnect the output shaft assembly and the reversal actuator to inhibit relative rotation between the output shaft assembly and the reversal actuator unless the motor is reversed.

6. A powered tool as set forth in claim 5 wherein the lock comprises a ball and a spring disposed in a first receptacle associated with one of the lug and the output shaft assembly, the spring biasing the ball outwardly of the first receptacle, the ball being selectively receivable in one of a pair of second receptacles in the other of the lug and the output shaft assembly when the first receptacle is aligned with either of the second receptacles for yieldably resisting relative rotation of the output shaft assembly and the reversal actuator.

7. A powered tool as set forth in claim 6 wherein the pocket is partially defined by the second surface portions and a third surface portion extending therebetween and the lug is partially defined by the first surface portions and a fourth surface portion extending therebetween, and the lock comprises a ball and a spring disposed in a first receptacle and projecting from one of the third surface portion and the fourth surface portion, the spring biasing the ball outwardly of the first receptacle, the ball being selectively receivable in one of a pair of second receptacles in the other of the third and fourth surface portions when the first receptacle is aligned with either of the second receptacles for yieldably resisting relative rotation of the output shaft assembly and the reversal actuator.

8. A powered tool as set forth in claim 7 wherein the first and second receptacles extend generally radially.

9. A powered tool as set forth in claim 8 wherein the second receptacles are separated an angle of arc approximately equal to the angle of arc of relative rotation between the reversal actuator and the output shaft assembly.

10. A powered tool as set forth in claim 1 wherein the reversal actuator comprises a first finger engageable with the pawl for pushing the pawl from the first position to the second position upon rotation of the reversal actuator relative to the output shaft assembly in the first direction, and a second finger engageable with the pawl for pushing the pawl from said second position to said first position upon rotation of the reversal actuator relative to the output assembly in the second direction.

11. A powered tool as set forth in claim 10 wherein the reversal actuator further comprises a bore in the reversal actuator for each of the first and second fingers, the first and second fingers being received in respective bores, the reversal actuator further including springs in each of the radial bores for biasing the first and second fingers outwardly of the bores.

12. A powered tool as set forth in claim 10 wherein the reversal actuator comprises a shaft having said bores therein, the shaft being disposed relative to the pawl whereby the shaft engages the pawl upon relative rotation of the reversal actuator and the output shaft assembly to disengage the pawl from the ratchet teeth.

13. A powered tool as set forth in claim 1 further comprising a drive shaft connected to the motor for rotation by the motor, the drive shaft being in direct driving engagement with the reversal actuator.

14. A powered tool as set forth in claim 1 wherein the reversal actuator comprises a shaft disposed relative to the pawl whereby the shaft engages the pawl upon relative rotation of the reversal actuator and the output shaft assembly to disengage the pawl from the ratchet teeth.

* * * * *